US008590886B2

(12) United States Patent
Kosugi

(10) Patent No.: US 8,590,886 B2
(45) Date of Patent: Nov. 26, 2013

(54) AIR-SUCTION SHEET SUPPLYING DEVICE AND IMAGE FORMING APPARATUS USING A BELT MEMBER DETECTING SECTION

(75) Inventor: Akira Kosugi, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 461 days.

(21) Appl. No.: 12/755,456

(22) Filed: Apr. 7, 2010

(65) Prior Publication Data

US 2010/0258996 A1 Oct. 14, 2010

(30) Foreign Application Priority Data

Apr. 10, 2009 (JP) ..... 2009-095688

(51) Int. Cl.
*B65H 3/12* (2006.01)

(52) U.S. Cl.
CPC ..... *B65H 3/124* (2013.01)
USPC ..... 271/96; 198/689.1

(58) Field of Classification Search
USPC ..... 271/96, 98; 198/689.1
See application file for complete search history.

(56) References Cited

U.S. PATENT DOCUMENTS

| | | | | |
|---|---|---|---|---|
| 2,852,256 | A * | 9/1958 | Faulls, Jr. et al. | 271/197 |
| 7,922,174 | B2 * | 4/2011 | Panides et al. | 198/689.1 |
| 2002/0011703 | A1 * | 1/2002 | Tomiyama et al. | 271/12 |

FOREIGN PATENT DOCUMENTS

| | | | | |
|---|---|---|---|---|
| JP | 59-43752 | A | | 3/1984 |
| JP | 62-93140 | A | | 4/1987 |
| JP | 1-143743 | U | | 10/1989 |
| JP | 01143743 | U | * | 10/1989 |
| JP | 2-81838 | A | | 3/1990 |
| JP | 6-144617 | A | | 5/1994 |
| JP | 06144617 | A | * | 5/1994 |
| JP | 9-67069 | A | | 3/1997 |
| JP | 2008-239312 | A | | 10/2008 |

OTHER PUBLICATIONS

Notice of Reasons for Refusal for Japanese Patent Application No. 2009-095688, mailed Oct. 2, 2012, with English translation.

* cited by examiner

*Primary Examiner* — Gerald McClain
(74) *Attorney, Agent, or Firm* — Cantor Colburn LLP

(57) ABSTRACT

An air-suction sheet supplying device includes a sheet stacking plate to stack recording sheets; an air-suction duct, arranged to face a top surface of the recording sheet stacked on the sheet stacking plate, and having an air-suction opening with a predetermined width; a belt member, rotatably arranged so as to cover the air-suction opening, and having plural areas having various distributions of suction holes in a direction perpendicular to a conveying direction; a driving section to rotate the belt member; a detecting section to detect a position of the belt member in a rotating direction; and a control section to operate the driving section so as to set a starting position of suction work, in a conveying direction of the belt member, on an area having suitable distribution of the suction holes, based on information detected by the detecting section.

7 Claims, 8 Drawing Sheets

AIR-SUCTION SHEET SUPPLYING DEVICE AND IMAGE FORMING APPARATUS USING A BELT MEMBER DETECTING SECTION

CROSS REFERENCE TO RELATED APPLICATION

This application is based on Japanese Patent Application No. 2009-095688 filed on Apr. 10, 2009, with the Japanese Patent Office, the entire content of which is hereby incorporated by reference.

TECHNICAL FIELD

The present invention relates to an air-suction sheet supplying device, which supplies recording sheets while sucking air off the sheet, and to an image forming apparatus, featuring said air-suction sheet supplying device.

BACKGROUND ART

In recent years, roller-method sheet supplying devices and air-suction method sheet supplying devices are well known as devices which supply the recording sheets to copying machines or printing machines, serving as the image forming apparatuses.

Concerning the roller-method sheet supplying devices, a sheet supplying roller rotates on the stacked recording sheets to send a single recording sheet one by one, in which sheet separation is conducted by friction force between the roller and the recording sheet, when said friction force is greater than friction force between recording sheets. However, when coated sheets, exhibiting high surface smoothness, are used as the recording sheets in high speed image forming apparatuses, sheet supplying malfunction or double sheets feeding frequently occurs.

Accordingly, the roller method sheet supplying devices have been used for small size printers, due to their low prices. However, said devices are not suitable as the sheet supplying devices which supplies a large number of various type sheets at high speed, whereby the air-suction sheet supplying devices have been generally used for such devices.

The air-suction sheet supplying device includes: a air-suction duct which is arranged to suck air from the recording sheets on a sheet stacking plate; and belts which rotate around the air-suction duct, wherein a plurality of air-suction holes are formed to penetrate the belts, so that air, sucked by the air-suction duct, vacuums the recording sheet through the holes. Since the belts are rotated, the vacuumed recording sheet is supplied to a conveying roller, arranged downstream.

Further, in order to exactly separate a single recording sheet, there is an air-suction sheet supplying device which includes an air blowing section to blow air to a leading edges of the recording sheets, or a sheet surfacing section to blow air at the edges of the recording sheet to separate the recording sheets. Said air-suction sheet supplying device is disclosed on Unexamined Japanese Patent Application Publication 2008-0239312, whereby said device can reliably separate recording sheets one by one, and supply the separated recording sheet downstream.

Concerning the above described air-suction sheet supplying device, if a suction opening of the air-suction duct is determined based on a large size recording sheet, and when small size recording sheets are used, air tends to be blown through the holes which do not cover the small size recording sheet (being air leakage), so that the small size recording sheet cannot be effectively vacuumed. In order to overcome this matter, if air-suction force is to be increased, a high power suction fan is necessary, which results in unwanted sound and increased production cost.

If the suction opening is determined based on a small size recording sheet, when the large size sheets are used, both edges of the recording sheet tend to hang over, so that the recording sheet is not conveyed smoothly, and may be adversely folded.

In order to overcome the above problems, in Unexamined Japanese Patent Publication Application 59-43752, a fan is used so as to change the suction force, based on the size of recording sheets, whereby said fan is controlled to rotate at low speed for the large size sheets, and to rotate at high speed for the small size sheets, in case of the small size recording sheets, air tends to escape from the suction opening.

Further, in Unexamined Japanese Patent Application Publication 06-14467, a shutter is used so as to change the size of the suction aperture, and said shutter is arranged between the suction opening of the air-suction duct and the conveying belt. Based on the size of the recording sheet, the size of the suction aperture can be changed by the shutter.

According to Unexamined Japanese Patent Publication Application 59-43,752, though the fan to change the suction force is provided, when the small size recording sheets are used, air is not prevented from escaping from the suction opening. To overcome air escaping, the fan is rotated at high speed, which is wasteful electrical supply.

According to Unexamined Japanese Patent Application Publication 06-144,617, a sheet, carrying various sizes of opening, serving as a shutter, is driven perpendicular to the recording sheet conveying direction, whereby said shutter sheet is driven by motors, arranged at both sides in the direction to convey the recording sheet, so that the dimensions of suction opening is changed. However, this structure, including the shutter sheet and the driving motors, is very complicated, and results in increased cost of the apparatus.

SUMMARY OF THE INVENTION

To overcome the above problems, in the present invention, a plurality of areas, having different distributions of air-suction holes, are provided on a sheet conveying belt, to suck air to convey the recording sheet, in a direction perpendicular to the recording sheet conveying direction, whereby, an area on the conveying belt is selected to convey the recording sheet, based on a size of the recording sheets to be used.

In more detail, an air-suction sheet supplying device of the present invention is characterized in that:

a sheet stacking plate to stack recording sheets;

an air-suction duct, arranged to face a top surface of the recording sheet stacked on the sheet stacking plate, and having an air-suction opening with a predetermined width, wherein the air-suction duct sucks air through the air-suction opening to draw up the recording sheet;

a belt member, rotatably arranged so as to cover the air-suction opening, and having plural areas having various distributions of suction holes in a direction perpendicular to a conveying direction, wherein the plural areas are arranged in a circumferential direction of the belt member;

a driving section to rotate the belt member;

a detecting section to detect a position of the belt member in a rotating direction; and a control section to operate the driving section so as to set a starting position of suction work, in a conveying direction of the belt member, on an area having suitable distribution of the suction holes, based on information detected by the detecting section, wherein the distribution of the suction holes is based on a size of the recording sheet.

BRIEF DESCRIPTION OF THE DRAWINGS

Embodiments will now be described, by way of example only, with reference to the accompanying drawings which are meant to be exemplary, not limiting, and wherein like elements are numbered alike in the several figures, in which.

DETAILED DESCRIPTION OF THE PREFERRED EMBODIMENT

Figure 1:
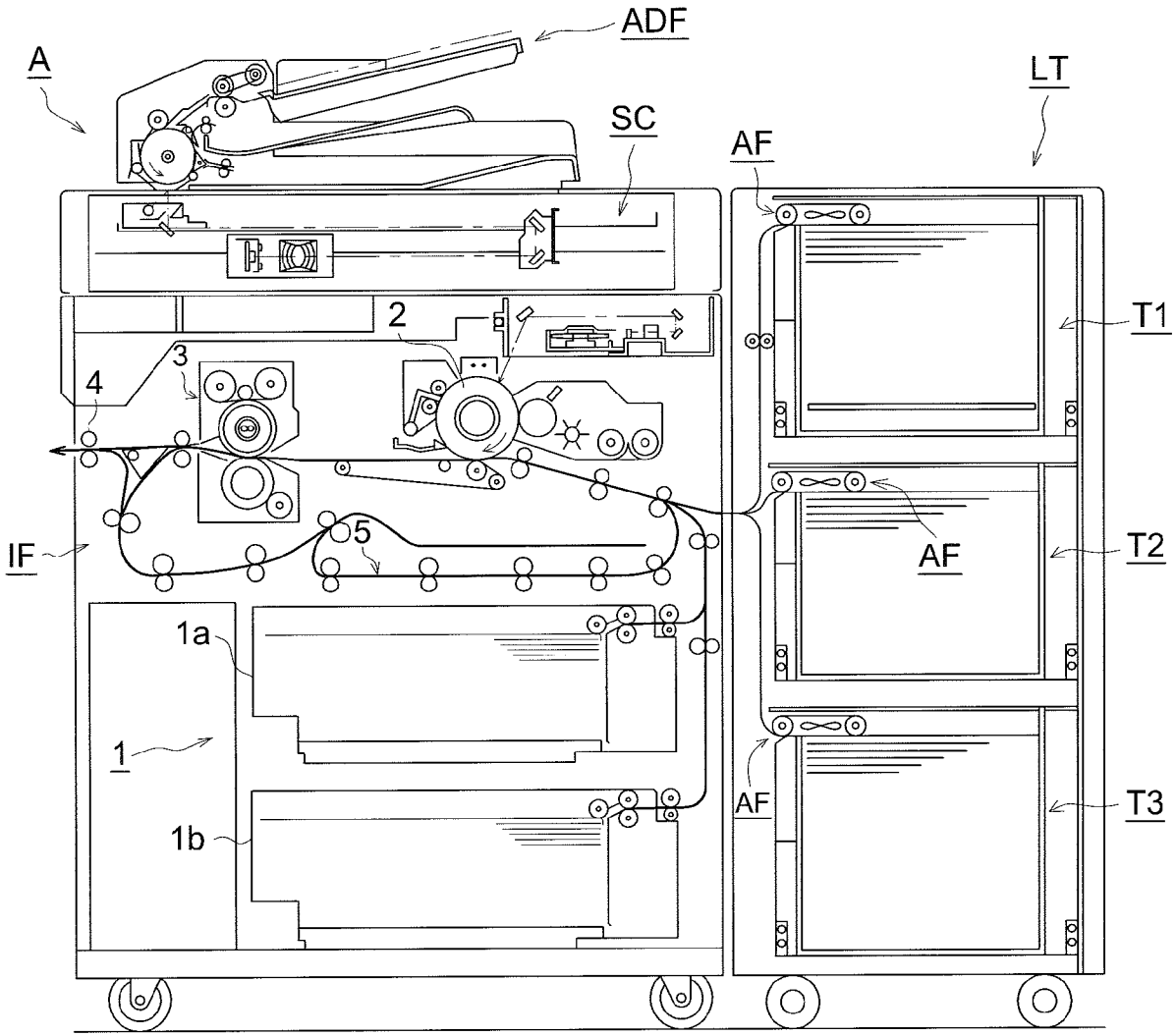
FIG. 1 shows an overall structure of an image forming apparatus relating to the present invention.

Embodiments of the present invention will now be detailed while referring to the drawings. FIG. 1 shows an overall structure of an image forming apparatus A, including large volume sheet supplying device LT.

In FIG. 1 large volume sheet supplying device LT includes sheet supplying stages T1, T2 and T3, which are connected to a sheet supplying path of image forming apparatus A. Above each of sheet supplying stages T1, T2 and T3, an air-suction sheet supplying device AF is installed respectively. Each of sheet supplying stages T1, T2 and T3 are pulled out through slide rails, so that various sizes of recording sheets can be accommodated, or maintenance work can be conducted.

Image forming apparatus A includes automatic document feeding device ADF, image reading section SC, and image forming section IF, wherein automatic document feeding device ADF and image reading section SC are mounted on image forming apparatus A, while image forming section IF is mounted on a lower section of image forming apparatus A.

Image forming section IF includes sheet accommodating section 1 and plural sheet supplying stages 1*a* and 1*b*. That is, the recording sheet is supplied from one of sheet supplying stages T1-T3 of large volume sheet supplying device LT, or from one of sheet supplying stages 1*a* and 1*b* of sheet accommodating section 1. Toner images formed on a photoconductive body 2 are transferred onto the recording sheet, having been supplied from one of the above stages, by an electrophotographic process. After that, the transferred images are permanently fixed by fixing device 3. The recording sheet carrying the images is ejected from ejecting section by paired ejection rollers 4.

In a case of double-surface image formation, the recording sheet carrying the fixed images on its front surface is directed downward before paired sheet ejection rollers 4. After that, said recording sheet is reversed on double-surface conveying path 5, and returned to a transfer position, whereby an image is formed on the reverse surface of the recording sheet.

Figure 2:
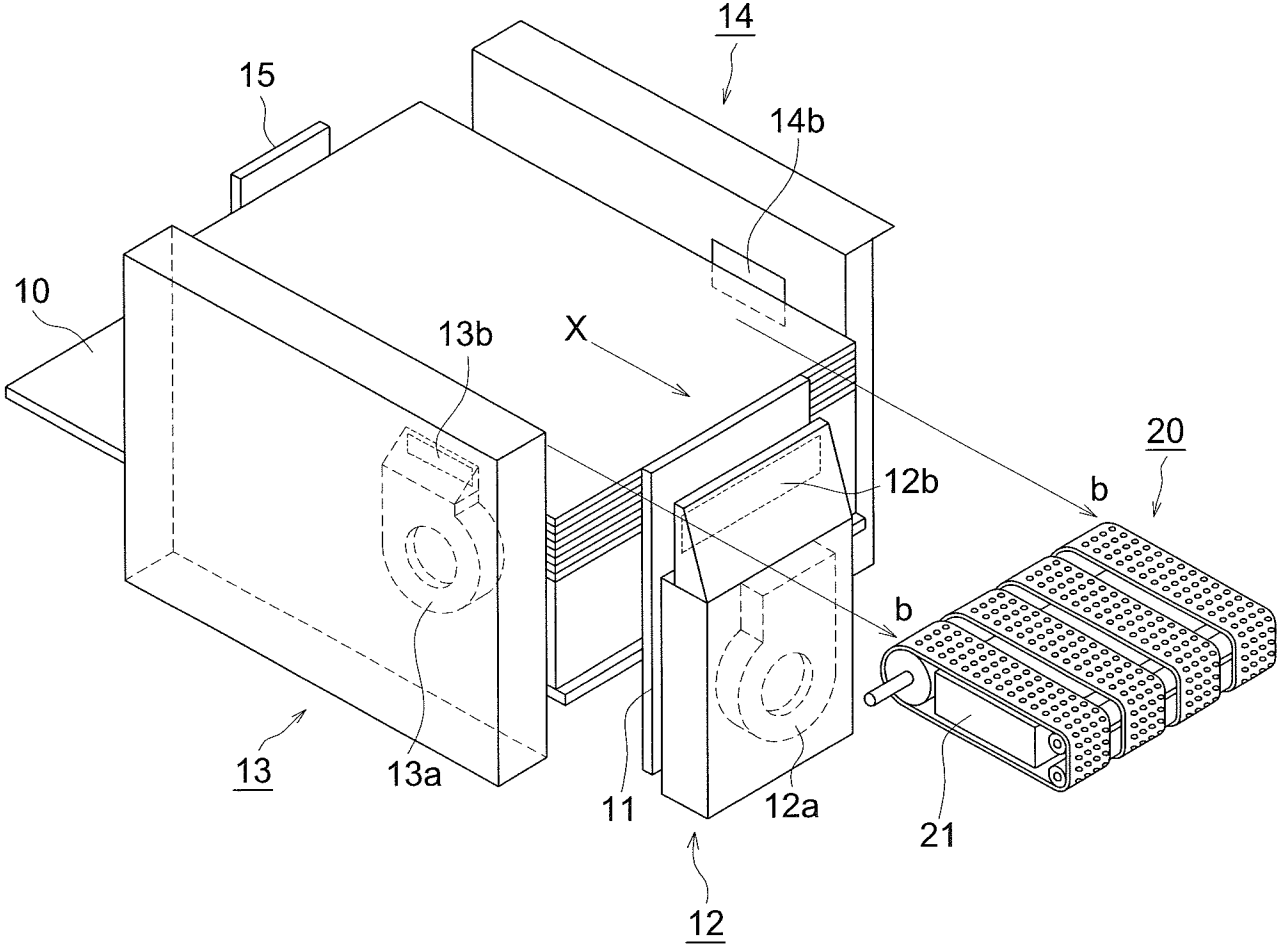
FIG. 2 is a perspective view of an air-suction sheet supplying device, relating to the present invention.

FIG. 2 shows a perspective view of an air-suction sheet supplying device to be used on large volume sheet supplying device LT. The recording sheets, stacked on sheet stacking plate 10, are conveyed one by one in arrowed direction X. Sheet stacking plate 10 is elevated upward so that an uppermost stacked sheet comes to a predetermined height, and is elevated downward to replenish new sheets.

Leading edge regulating member 11 is mounted in front of sheet accommodating plate 10. Separating air blowing section 12 is mounted downstream of leading edge regulating member 11. Sheet-floating air blowing sections 13 and 14 are mounted on both sides of sheet accommodating plate 10. Inner surfaces of sheet floating air blowing sections 13 and 14 regulate the edges of the stacked recording sheets. Trailing edge regulating member 15 is mounted to push on the trailing edges of the stacked recording sheets.

Air blow fan 12*a* is mounted in separating air blowing section 12, and air fans 13*a* and 14*a* are mounted in sheet-floating air blowing sections 13 and 14, respectively. Air blows through air outlets 12*b*, 13*b* and 14*b*.

Air-suction sheet supplying device AF is mounted above sheet accommodating plate 10. In FIG. 2, conveying belts 20, being shifted in arrowed directions "b" for case of explanation, are shown. Air-suction duct 21 is mounted in an interior portion of conveying belts 20.

The recording sheets, accommodated on sheet accommodating plate 10, are vacuumed one by one by air-suction sheet supplying device AF. In more detail, sheet-floating air blowing sections 13 and 14 blow air on both edges of the recording sheets, so that the recording sheets, being two or three sheets, are floated on air, and separating air blowing section 12 simultaneously blows air toward the leading edges of the recording sheets, whereby the uppermost recording sheet, vacuumed by air-suction sheet supplying device AF, is independently separated from the remaining stacked sheets.

Figure 3:
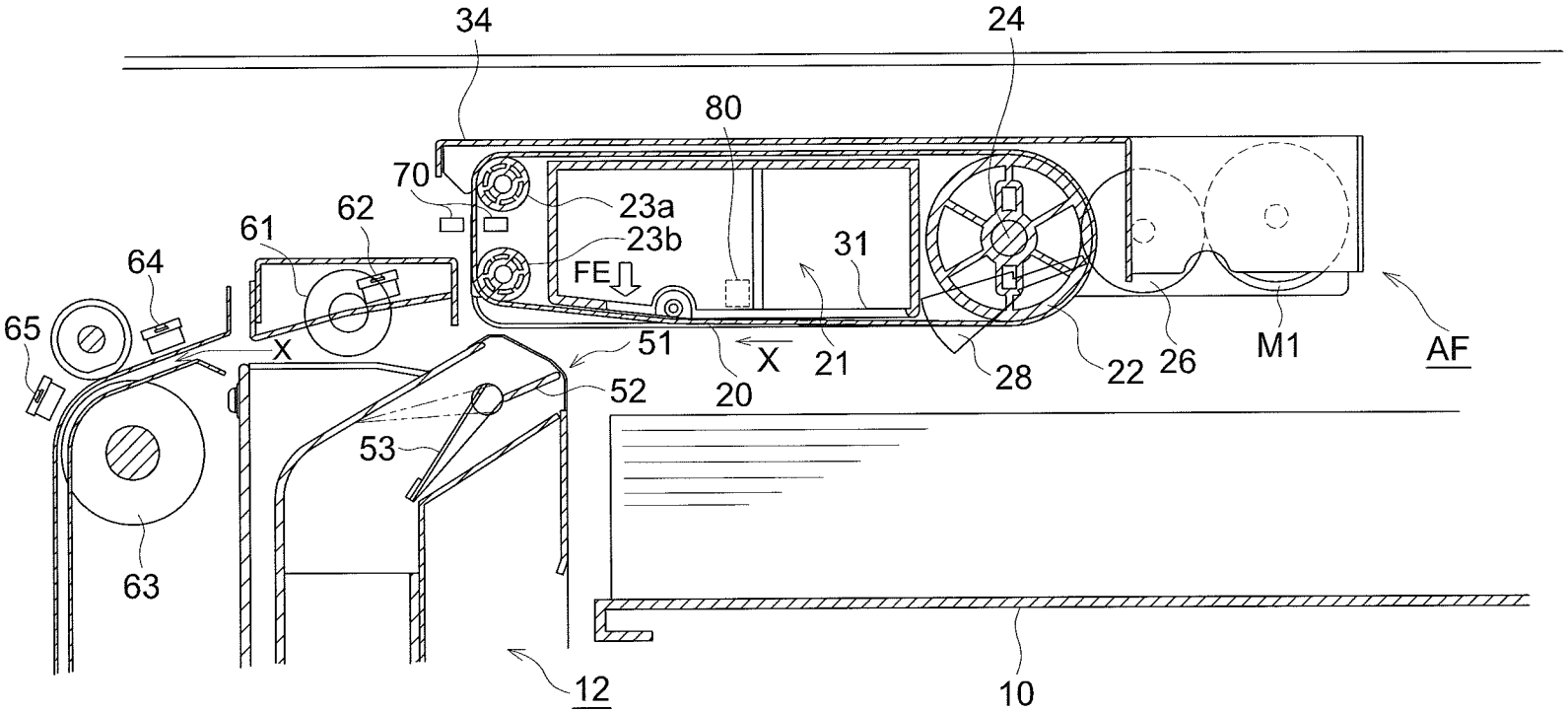
FIG. 3 is a cross sectional view of relevant portions of the air-suction sheet supplying device, relating to the present invention.
Figure 4:
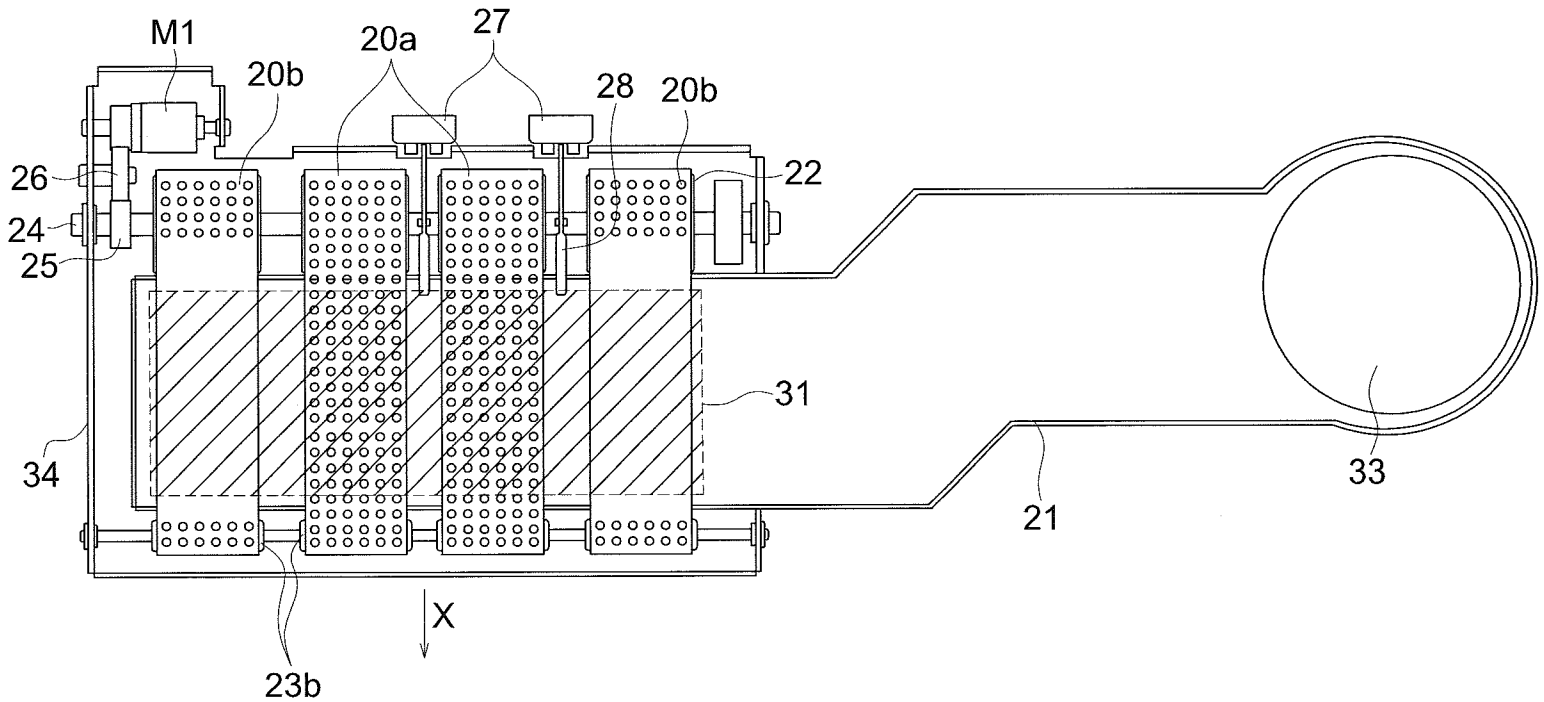
FIG. 4 is a bottom view of the air-suction sheet supplying device as Embodiment 1, relating to the present invention.

FIG. 3 shows relevant sections of air-suction sheet supplying device AF and its peripheral sections, while FIG. 4 is a bottom view of air-suction sheet supplying device AF as Embodiment 1, viewed from the bottom of FIG. 3. Air-suction sheet supplying device AF will now be detailed, while referring to FIGS. 3 and 4.

Air-suction sheet supplying device AF, positioned above sheet accommodating plate 10, includes air-suction duct 21, large diameter roller 22, mounted upstream in the sheet supplying direction, two small diameter rollers 23*a* and 23*b*, mounted downstream in the sheet supplying direction, and conveying belts 20, entrained about the above described rollers. Conveying belts 20 represent perforated belts, having plural holes through their surfaces. As shown in FIG. 4, four belts are mounted perpendicular to the sheet supplying direction. The structure of conveying belts 20 will be detailed later.

Large diameter roller 22 and small diameter roller 23*a* and 23*b* are formed to be barrel shapes, so that rotating belts 20 do not shift in their axial directions. Further, flanges can be provided on the rollers to prevent the belts from shifting.

Air-suction duct 21 is structured of a section to face four conveying belts 20, and an air-suction duct section. Suction opening 31 is provided near a bottom surface of the section to face four conveying belts 20. Air-suction fan 33 is arranged at the end of air-suction duct 21.

Supporting plate 34 is mounted on air-suction duct 21. A front supporting member and rear supporting member of supporting plate 34 support large diameter roller 22 and small diameter rollers 23*a* and 23*b*, and gear 25 is mounted on shaft 24 of large diameter roller 22. Gear 25 is connected to motor M1, having a clutch, through gear 26. Gear 26 and motor M1 are supported by supporting plate 34.

Detection flaps 28 of suction sensor 27 are mounted at two positions within large diameter roller 22. When the recording sheet is vacuumed detecting flap 28 is shifted so that suction sensor 27 detects that a recording sheet has been vacuumed.

In FIG. 3, separation air blowing section 12 is positioned below small diameter roller 23*b* of air-suction sheet supplying device AF. Dividing wall 52 and switching plate 53 are mounted within blow opening 51 of separation air blowing section 12, whereby when switching plate 53 moves from a position illustrated by a real line to a position illustrated by a chain double-dashed line, so that the blowing direction of separating air is changed. When the air-suction of the recording sheet is started, switching plate 53 exists on the position of the chain double-dashed line, so that air is blown through lower opening. After a few recording sheets are floated by floating air and are vacuumed, switching plate 53 moves to the position of real line, so that air is blown through upper opening, whereby the recording sheet is exactly separated.

Above separating-air blowing section 12, roller 61 is positioned to support the sheet conveyance, and sheet supplying sensor 62 is arranged upstream of roller 61 in the sheet conveying direction. Conveying roller 63 is arranged downstream of roller 61, pre-registration sensor 64 is arranged upstream of conveying roller 63, and conveyance sensor 65 is arranged downstream of conveying roller 63, in the sheet conveying direction. The air-suction sheet conveyance system is controlled, based on signals sent from these sensors.

Figure 8:
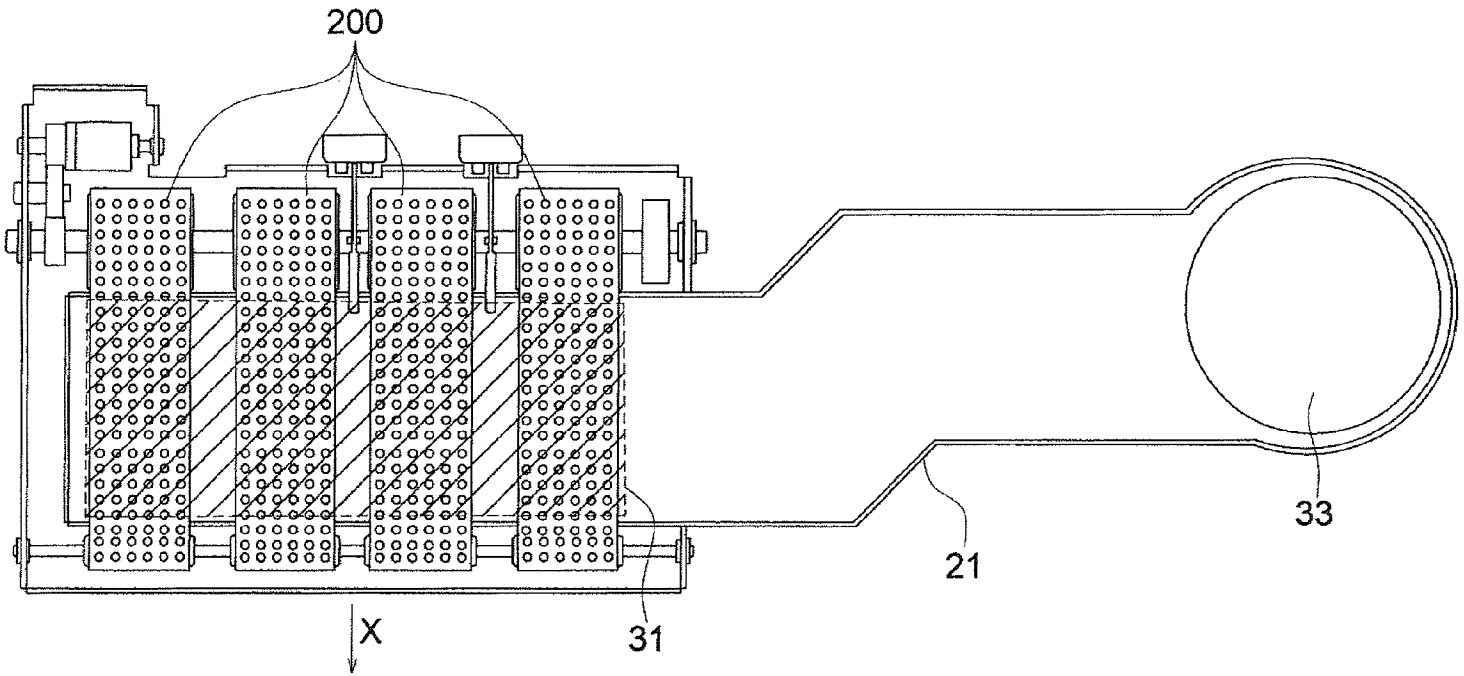
FIG. 8 CONVENTIONAL ART
FIG. 8 is a bottom view of the air-suction sheet supplying device as a conventional art.

Sheet conveying belts, used in a conventional air-suction sheet supplying device, will now be detailed while referring to FIG. 8. FIG. 8 is the bottom view of the conventional air-suction sheet supplying device. Four conveying belts 200 shown in FIG. 8 have air-suction holes, but the four belts are the same structure with each other, Accordingly, identical suction force is applied to the recording sheet through suction opening 31, whereby if the size of the recording sheets changes, the problems listed above will occur.

Returning to FIG. 4, the conveying belts of the present invention will now be detailed. Two inner conveying belts 20*a* have suction holes on their whole circumference, which is the same as in the case of conventional belts 200. However, the two outer conveying belts 20*b* have an area having the suction holes, and an area having no suction holes.

Figure 5:
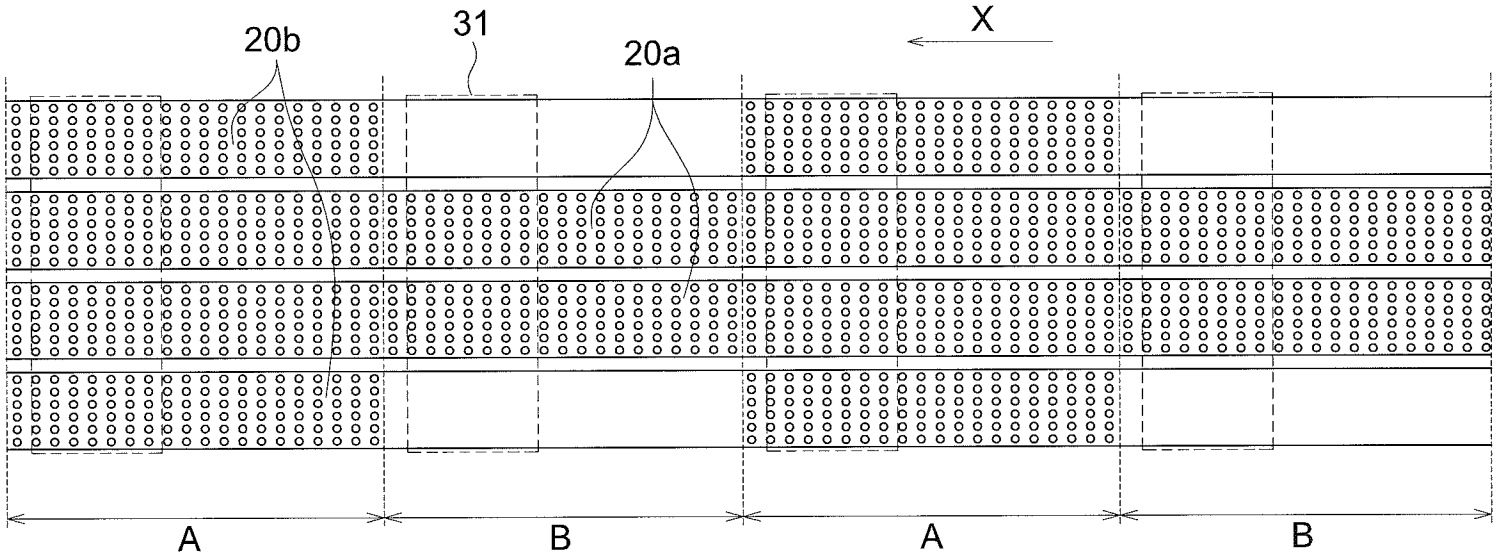
FIG. 5 is a pattern development view of conveying belts as Embodiment 1, relating to the present invention.

FIG. 5 shows four conveying belts, which are extended, wherein arrowed direction X represents the rotating direction of the conveying belts, that is, the sheet conveying direction. Two inner conveying belts 20*a* have suction holes on their total areas (being the total circumferences), while the two outer conveying belts 20*b* have holed areas and non-holed areas, both exist alternately along the circumference. Accordingly, first area "A", having the suction holes, and second area "B", having no suction hole, are alternately formed on the total circumferences of conveying belts 20*b*.

According to the present invention, the area of the conveying belts to vacuum the recording sheet is changed, based on the size of recording sheet to be used. That is, first area A is used for conveying a large size recording sheet, while second area B is used for conveying a small size recording sheet. To change the areas, a driving source of the conveying belts is used without modification, resulting in low production cost.

In order to change the areas to vacuum the recording sheet, based on the size of recording sheet, a sensor unit to detect positions of the conveying belts is used in the present invention. In FIG. 3, belt position detecting sensor 70, including a light emitting element and a light receiving element, is provided between small diameter rollers 23*a* and 23*b* to sandwich conveying belt 20.

Concerning the mounting position of sensor 70 with respect to the sheet width direction, said sensor 70 is mounted on a position on which the suction holes of outer conveying belt 20*b* pass, whereby when first area A passes over sensor 70, sensor 70 outputs pulse signals as the suction holes, while when second area B passes over sensor 70, sensor 70 outputs no signal. Accordingly, a border between first area A and second area B can be detected by the signals coming from sensor 70. After that conveying belts 20*a* and 20*b* are driven for a predetermined length, whereby the top of first area A or second area B can be controlled to meet the front edge (being a position to start air vacuuming, which position is shown by symbol FE in FIG. 3) of suction opening 31 of air-suction duct 21. The above predetermined length can be controlled by a clock-timer, or number of pulses outputted from a pulse encoder connected to motor M1.

Further since first area A and second area B are switched to each other, an area which is not used is passed for sheet conveyance. Accordingly, between one sheet conveyance and the next sheet conveyance, air suction operation, floating air operation, and separating air operations are deactivated, and while said deactivated interval, the next area of the conveying belts is controlled to reach suction opening 31.

In the present invention, the width of first area A, which is measured in a direction perpendicular to the sheet conveyance direction, has been determined between the width of longitudinal A4 sheet and the width of longitudinal B5 sheet, while the width of second area B has been determined between the widths of longitudinal A5 sheet and the width of longitudinal B5 sheet. However, these widths can be desirably determined, based on the sheet sizes to be used in the image forming apparatus. In Embodiment 1, the width of a suction hole section in second area B, is smaller than that of area A. In other words, the total area of the suction hole section of second area B is smaller than that of first area A. Further, in Embodiment 1, four surfaces, including two areas A and two areas B, are formed. Otherwise, six surfaces, including two largest areas, two middle areas, and two smallest areas, can be used.

Figure 6:
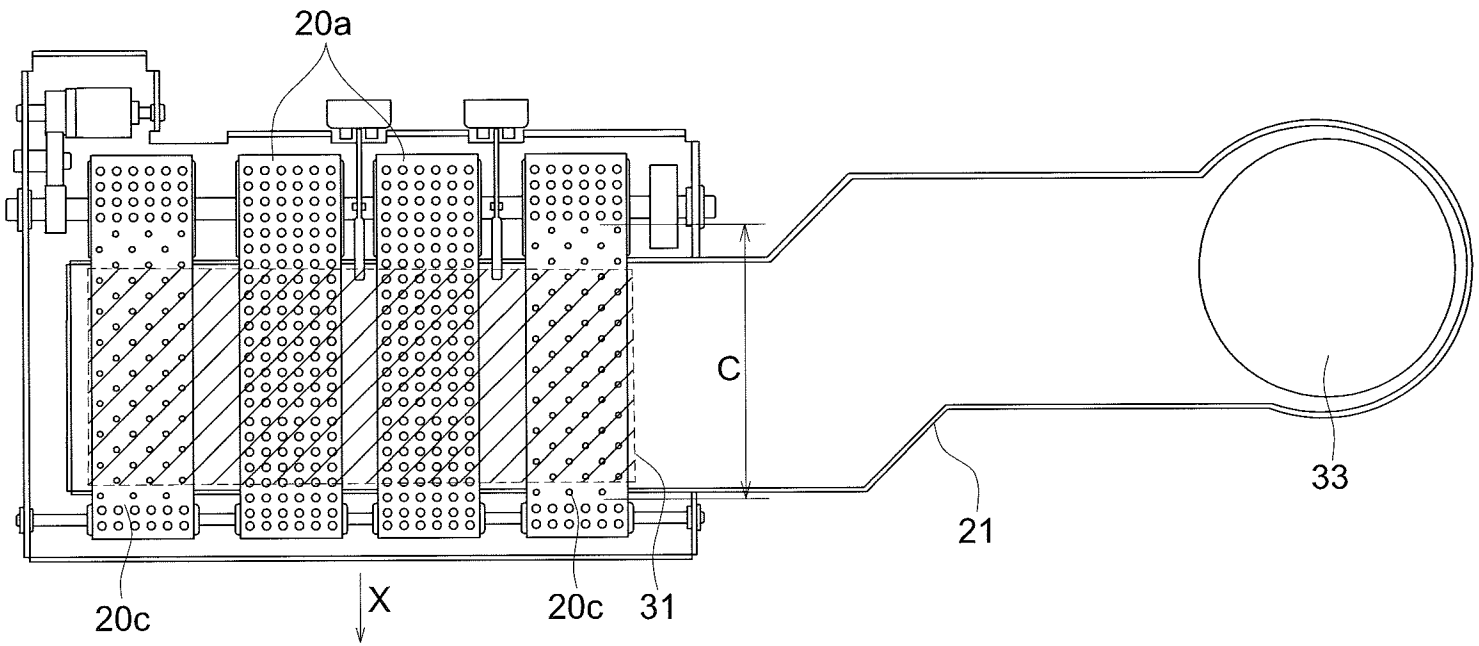
FIG. 6 is a bottom view of the air-suction sheet supplying device as Embodiment 2, relating to the present invention.

Conveying belts of Embodiment 2 will now be detailed while referring to FIG. 6. Inner conveying belts 20*a* have the suction holes on their total circumferential surfaces, being the same as in the case of Embodiment 1. Outer conveying belts 20*c* include sections having large suction holes, and sections having small suction holes, wherein the distribution of the small suction holes is less dense. The large size sheet is conveyed by the sections having the large suction holes (being first area A), while the small size sheet is conveyed by the sections having the small less dense suction holes (being second area C). On area C, the area formed of the suction holes is smaller so that the air leakage can be effectively decreased. Further, when a middle size sheet is conveyed by second area C, the air-suction force is sufficient, and air leakage becomes negligible, when compared to the case in that the middle size sheet is conveyed by first area A.

In Embodiment 2, second area C of outer conveying belts 20 have the small suction holes and the less dense suction holes. However, if either one of the small suction holes or the less dense of suction holes is formed on second area C, acceptable results can be obtained.

Figure 7:
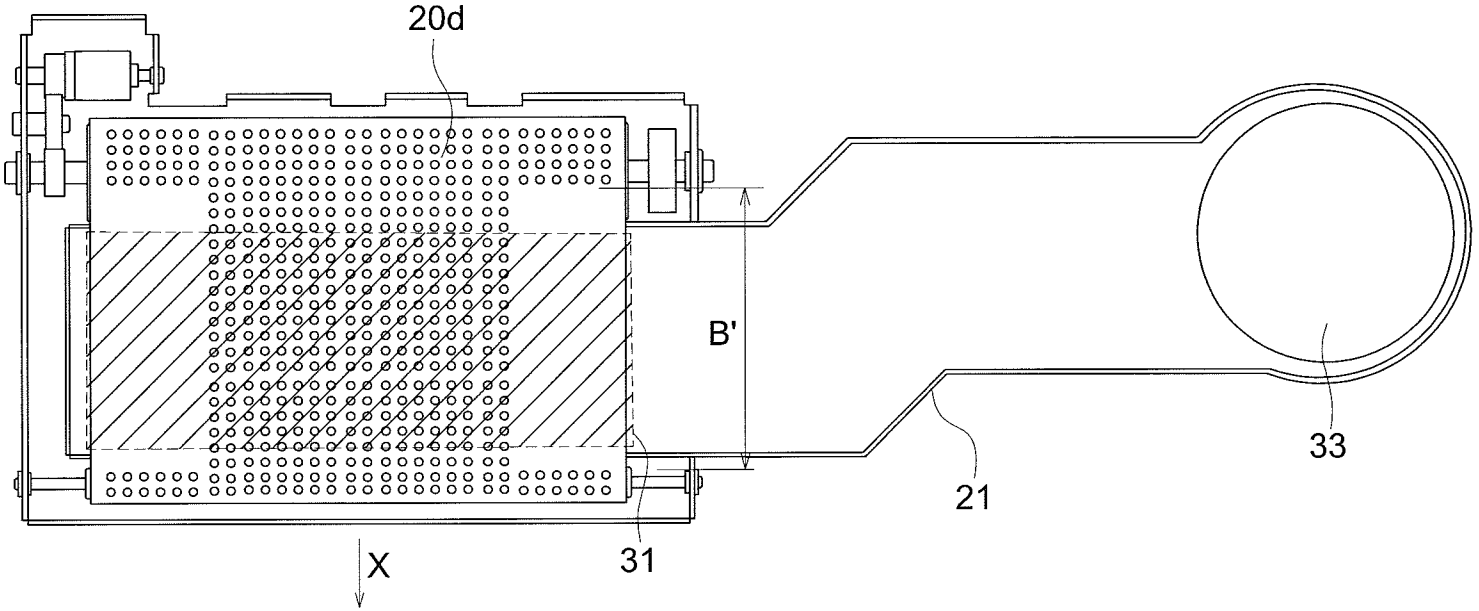
FIG. 7 is a bottom view of the air-suction sheet supplying device as Embodiment 3, relating to the present invention.

FIG. 7 shows a conveying belt of Embodiment 3 of the present invention. Conveying belt 20*d* of Embodiment 3 is formed of a single conveying belt. Said conveying belt is formed of a section having suction holes on its total width (being first area A) and a section having no suction holes on both edges (being second area B'). In FIG. 7, the operational area of second area B' is shown by the double leaded arrow.

Drive control of the conveying belt in Embodiment 3 is equal to the case of Embodiment 1, however, since a single belt is used, suction sensor 27 shown in FIG. 4, being the mechanical sensor in Embodiment 1, cannot be used in Embodiment 3. Accordingly, a suction sensor in Embodiment 3 represents a photo-electrical sensor. Light reflection suction sensor 80, shown by dashed line in FIG. 3, is mounted within suction opening 31 of air-suction duct 21. Light reflection suction sensor 80 is configured to be positioned just above the suction holes arranged on the center of the width of the conveying belt.

In case that the recording sheet is not drawn up via vacuum, the light passes through the suction hole, so that the amount of light received by a light receiving element changes intermittently, and in case that a recording sheet is vacuumed, the light, reflected by the recording sheet on the suction hole, is received by the light receiving element, whereby sheet vacuuming is detected by the difference of amount of light between the above two cases. To detect the sheet vacuum by the above method, previously checked are that: the reflected amount of light at a portion having no suction hole inside the conveying belt; the amount of light in case of no reflection to face the suction hole; and the amount of reflected light when a recording sheet is vacuumed and the suction hole is covered by the recording sheet.

In each embodiment detailed above, concerning the suction holes, which are formed on the conveying belt of the area to convey the small size recording sheet, there are the cases, listed below:

areas having no suction hole are provided on the outer sides across the width of the conveying belt;

the diameter of suction holes, existing on the outer sides across the width of the conveying belt, is smaller than that of suction holes existing near the center of the width of the conveying belt; and the distribution of the suction holes, existing on the outer sides across the width of the conveying belt, is less dense than that of the center of the width of the conveying belt.

Combined cases of the above can also be used for carrying out the embodiments. Further, the distribution of the suction holes is determined by comparing the distribution to the area having the suction holes on its total width.

Embodiments 1-3 have been detailed above, however, variations of the embodiments can be formed without changing the purpose of the invention. For example, the position of the conveying belt has been detected by detecting the suction holes, instead, a mark is formed on the conveying belt, so that the mark is detected to determine the position of the conveying belt. Further, a stepping motor is used as motor M1, instead of the sensor. The position can be detected by counting the driving pulses of said stepping motor. In the present invention, the detection of the conveying belts include the above methods.

Still further, In Embodiment 1, the outer conveying belts and the inner conveying belts are individually driven, whereby the outer conveying belts are driven to switch between first area A for the large size sheet and second area B for the small size sheet, and the inner conveying belts function to draw up a sheet via vacuum, and convey the recording sheet. The outer conveying belts can also be used for vacuuming and conveying the recording sheet. When the outer conveying belts are used only for switching the areas as described above, if the recording sheets are continuously supplied, a time interval for switching the areas becomes unnecessary, so that the high speed operation can be realized. In this case, since the recording sheet is conveyed while being in contact with the outer conveying belts, the surfaces of the outer conveying belts should be coated with Teflon (being the trade mark), so that the friction between the belts and the recording sheet can be reduced. Otherwise, the surfaces of the inner conveying belts will be finished via an embossing process, so the friction between the inner conveying belts and the recording sheet will be increased.

Further, while the preferred embodiments of the present invention have been described using specific terms, such description is for illustrative purpose only, and it is to be understood that changes and variations may be made without departing from the spirit and scope of the appended claims.

What is claimed is:

1. An air-suction sheet supplying device, comprising:

a sheet stacking plate to stack recording sheets;

an air-suction duct, arranged to face a top surface of the recording sheet stacked on the sheet stacking plate, and having an air-suction opening with a predetermined width, wherein the air-suction duct sucks air through the air-suction opening to draw up the recording sheet;

a belt member, rotatably arranged at a position to cover the air-suction opening along an outer periphery of the air-suction duct, so as to draw up and convey the recording sheet exhibiting a predetermined sheet-size among the recording sheets exhibiting various sheet-sizes, the belt member having plural areas corresponding to the sheet-sizes, wherein each of the plural areas includes suction holes, and the plural areas are arranged in a circumferential direction of the belt member, wherein distributions of the suction holes are different with respect to the plural areas in a direction perpendicular to a sheet conveying direction;

a driving section to rotate the belt member;

a detecting section to detect a position of the belt member in a rotating direction; and a control section to operate the driving section so as to set a starting position of suction work on a selected area selected among the plural areas, wherein the selected area corresponds to a selected sheet-size of the recording sheets, based on information detected by the detecting section wherein the air-suction duct is arranged in a total direction perpendicular to the conveying direction of the belt member;

wherein an area of the plural areas corresponding to a first sheet-size is arranged sequentially with respect to an area of the plural areas corresponding to a second sheet-size.

2. The air-suction sheet supplying device of claim 1, wherein the plural areas, having the various distribution of the suction holes formed on the belt member, include a first area and a second area, the second area sucks the recording sheet which is smaller than the recording sheet to be sucked by the first area, both areas being arranged in the circumferential direction, wherein a total area of the suction holes of the second area is smaller than the total area of the first area, or a diameter of the suction hole formed on an outer portion of the belt member in the direction perpendicular to the conveying direction is smaller than the diameter of the suction hole formed on a center portion of the belt member, or the number of the suction holes formed on the outer portion of the belt member is smaller than the number of the suction holes formed on the center portion of the belt member.

3. The air-suction sheet supplying device of claim 2, wherein the plural areas are arranged on the belt member in a circumferential direction of the belt member.

4. The air-suction sheet supplying device of claim 1, wherein the belt member includes plural belts, which are outer belts and inner belts, arranged in the direction perpendicular to the conveying direction, wherein the outer belt has an area having no suction hole, or the diameter of the suction holes formed on the outer belts is smaller than the diameter of the suction holes formed on the inner belts, or the number of the suction holes on the outer belts is smaller than the number of the suction holes on the inner belts.

5. The air-suction sheet supplying device of claim 1, wherein the detecting section includes a sensor to detect the suction hole formed on the belt member.

6. The air-suction sheet supplying device of claim 1, wherein the detecting section includes a sensor to detect a mark formed on a surface of the belt member.

7. An image forming apparatus, including:

an image forming section to form an image on a recording sheet, and an air-suction sheet supplying device, including:

a sheet stacking plate to stack recording sheets;

an air-suction duct, arranged to face a top surface of the recording sheet stacked on the sheet stacking plate, and having an air-suction opening with a predetermined width, wherein the air-suction duct sucks air through the air-suction opening to draw up the recording sheet;

a belt member, rotatably arranged at a position to cover the air-suction opening along an outer periphery of the air-suction duct, so as to draw up and convey the recording sheet exhibiting a predetermined sheet-size among the recording sheets exhibiting various sheet-sizes, the belt member having plural areas corresponding to the sheet-sizes, wherein each of the plural areas includes suction holes, and the plural areas are arranged in a circumferential direction of the belt member, wherein distributions of the suction holes are different with respect to the plural areas in a direction perpendicular to a sheet conveying direction;

a driving section to rotate the belt member;

a detecting section to detect a position of the belt member in a rotating direction; and a control section to operate the driving section so as to set a starting position of suction work on a selected area selected among the plural areas, wherein the selected area corresponds to a selected sheet-size of the recording sheets, based on information detected by the detecting section, wherein the air-suction duct is arranged in a total direction perpendicular to the conveying direction of the belt member;

wherein an area of the plural areas corresponding to a first sheet-size is arranged sequentially with respect to an area of the plural areas corresponding to a second sheet-size.

* * * * *